United States Patent [19]

Rottenberg et al.

[11] 4,397,240

[45] Aug. 9, 1983

[54] ROCKET ASSISTED PROJECTILE AND CARTRIDGE WITH TIME DELAY IGNITION AND SEALING ARRANGEMENT

[75] Inventors: Mark M. Rottenberg; William O. Davis, both of Baltimore County, Md.

[73] Assignee: AAI Corporation, Cockeysville, Md.

[21] Appl. No.: 168,948

[22] Filed: Jul. 11, 1980

Related U.S. Application Data

[63] Continuation of Ser. No. 857,956, Dec. 6, 1977, abandoned.

[51] Int. Cl.[3] ..... F42B 15/10

[52] U.S. Cl. ..... 102/376; 102/518

[58] Field of Search ..... 102/517, 518, 519, 501, 102/374, 376, 379, 380, 381, 290, 372, 373

[56] References Cited

U.S. PATENT DOCUMENTS 3,277,825 10/1966 Maillard ..... 102/518
3,754,507 8/1973 Dillinger et al. ..... 102/518
3,765,177 10/1973 Ritchey et al. ..... 102/290
3,981,241 9/1976 Ambrosine et al. ..... 102/374

*Primary Examiner*—Harold J. Tudor
*Attorney, Agent, or Firm*—Reginald F. Pippin, Jr.

[57] ABSTRACT

A cartridge arrangement having a rocket assisted projectile for firing therefrom by ignition of propellant in the cartridge case and for subsequent ignition of a rocket grain within the projectile, in which the projectile has a sealed tubular chamber cavity encompassing a tubular or ring shaped end burning rocket grain, the rear end of which chamber is formed by a combined nozzle block and rear penetrator support which has nozzle openings sealed by ignitable time delay igniter plugs, and the outer, inner, and forward extremities of which are bounded by a thin-walled projectile case, a cylindrical penetrator, and a forward penetrator support, and which ignitable time delay igniter plugs are externally ignitable by the burning of the propellant to enable subsequent ignition of the adjacent end of the rocket grain.

4 Claims, 3 Drawing Figures

ROCKET ASSISTED PROJECTILE AND CARTRIDGE WITH TIME DELAY IGNITION AND SEALING ARRANGEMENT

This is a continuation of application Ser. No. 857,956 filed Dec. 6, 1977, now abandoned.

DISCLOSURE

This invention relates to a rocket assisted projectile and a cartridge arrangement having a rocket assisted projectile, in which the projectile has a rocket grain carried within a chamber surrounding a coaxial penetrator and in which the rocket grain is ignitable by time delay igniters initially plugging nozzle openings connecting with the rocket grain chamber and the rocket grain contained therein.

Previous efforts in this area have not been successful as the rocket grain was not configured to burn in a satisfactory manner when subjected to the extreme acceleration and spin environment typical of gun-launched projectiles. Also previous projectiles had unacceptably low mass fractions and payloads as the projectile shell had to be designed to withstand the high pressure internal loads imposed by the gun propellant gases.

It is a feature of this invention to provide a rocket assisted projectile and cartridge containing such, in which the particular payload and/or target velocity may be maximized, through employment of time delay nozzle plug igniters in the rocket nozzles, which igniters burn through after substantial reduction from peak propellant gas pressure occurs.

It is a further feature of this invention to provide an improved cartridge and rocket assisted projectile arrangement to enable increased projectile down range striking velocity through the use of a coaxial delayed ignition tubular or ring shaped rocket grain and generally cylindrical penetrator therewithin, allowing penetrator payload to be maximized.

Still other objects, features and attendant advantages will become apparent from a reading of the following detailed description of a preferred embodiment constructed in accordance with the invention, taken in conjunction with the accompanying drawing, wherein.

Figure 1:
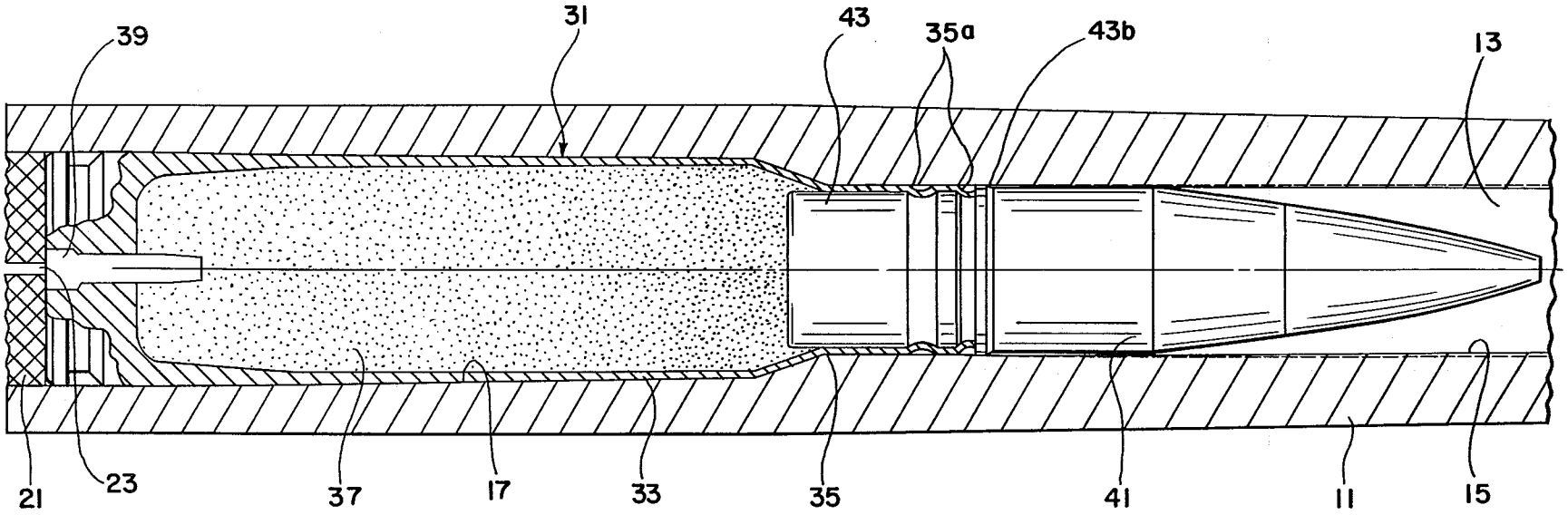
FIG. 1 is a view in partial longitudinal section of a chambered cartridge with a projectile according to the invention.
Figure 2:
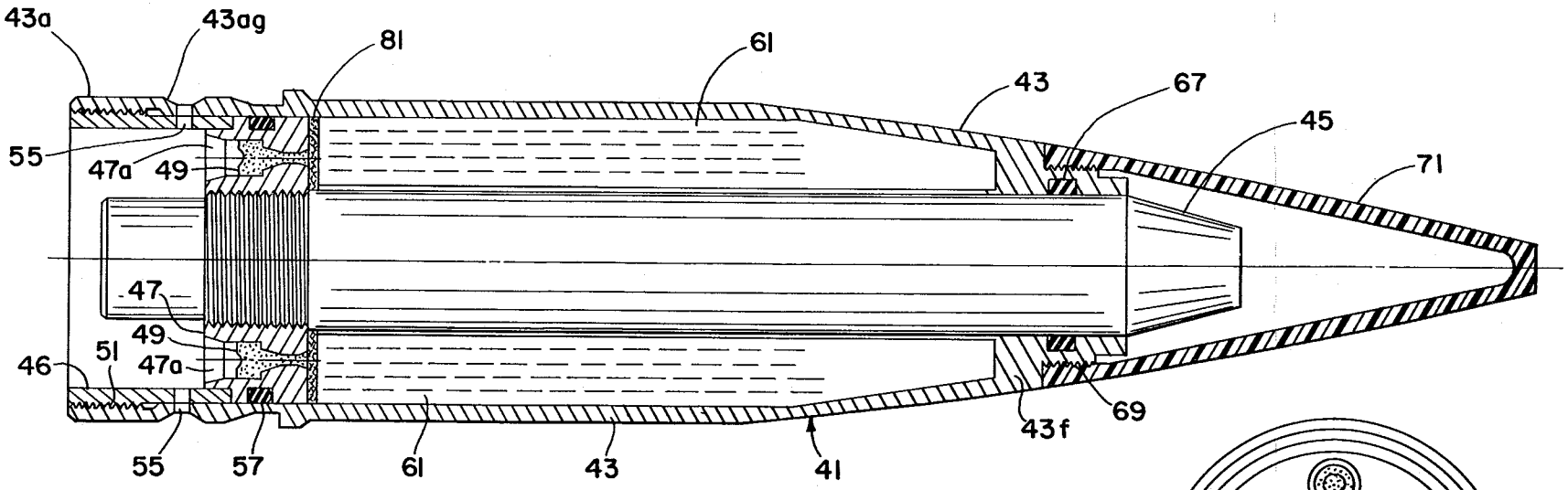
FIG. 2 is a longitudinal section view of the projectile of FIG. 1.
Figure 3:
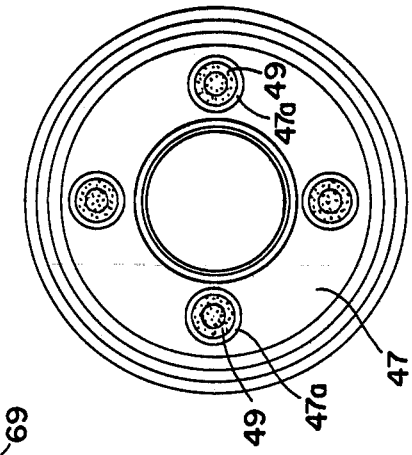
FIG. 3 is a rear end view of the projectile of FIGS. 1 and 2.

Referring now in detail to the Figures of the drawing, a cartridge 31 has a rocket assisted projectile 41, with ignitable propellant mix 37 within a case or casing 33 for initial propulsion of the projectile 41 and ultimate ignition of a rocket propellant grain 61 within the projectile 41.

The cartridge case 33 has a suitable percussion primer 39 which may be suitably fired by a firing pin 23 after chambering of the cartridge within a cartridge chamber 17 of a barrel 11 and closure of the bolt 21. Projectile 41 has an annular rotating band **43*b* formed on its body case 43, for engagement with the rifling 15 of the barrel bore 13**.

Projectile 41 is releasably secured within the open-mouthed necked down forward end 35 of cartridge case or casing 33 by annular crimping, as at **35*a*, of the casing 33 into outer annular grooves 43*ag* formed on the projectile case 43. To enable this securement, an annular securing skirt 43*a* is formed as the rear end of projectile case 43 extending rearwardly behind the rotating band 43*b* of the case 43, and the annular crimping grooves 43*ag*** are formed in its surface.

Rocket assisted projectile 41 has a generally cylindrical target penetrator of suitable high density material such as steel, tungsten, etc., substantially smaller in diameter than the outer diameter of the projectile case 43, which penetrator is carried in coaxial relation within thin-walled projectile case 43, being supported and axially secured against axial movement at its rear end by a nozzle block 47 which is fitted with an O-ring seal 57 within projectile case 43. At its forward end, which is preferably tapered for aid in target penetration, the penetrator 45 is press fit within and supported in stabilized coaxial rotation-imparting relation within case 43 and a tubular propellant grain 61 by a forward support block **43*f* integral with the projectile case, an O-ring 67 being employed for added sealing capability. A suitable preferably thin-walled windshield 71 may be secured over the nose end of penetrator 45 by threaded engagement, as at 69, with the forward end 43*f* of case 43**.

As an aid to retention of the nozzle block within case 43, a retaining ring or sleeve 46 is threadedly secured, as at 51, within securing skirt **43*a* and engages the rear end surface of nozzle block 47** in securing relation thereto.

Penetrator 45 is threadedly secured within and carried by nozzle block 47 in coaxial relation to the block 47 and case 43, thereby effectively securing the penetrator against longitudinal slippage relative to the nozzle block and the remainder of the projectile 41.

An end burning rocket propellant grain 61 occupies the tubular chamber formed between the projectile case 43 and penetrator 45, having a suitable burn-inhibiting coating or treatment along its radially inner and outer and forward surfaces to aid in assuring progressive rear end burning without undesired spurious lateral or forward end burning.

Propellant grain 61 is ignited by annularly spaced igniter delay plugs 49 secured within and initially sealing corresponding nozzle discharge openings **47*a* formed in nozzle block 47 and through which the reaction exhaust products from burning of propellant grain 61 are discharged after ignition of the propellant grain 61. The igniter plugs 49 serve to enable ignition of the end surface of rocket propellant grain 61, and are themselves ignited from contact by the hot burning gases from the cartridge propellant mix 37 while the projectile is within the case 33 or the barrel bore 13. The igniter plugs serve both to transmit ignition to the rocket grain 61 after a time delay, and to seal the rocket propellant grain and its projectile/case/nozzle block-forming containment chamber interior from the very high propellant gas pressures resulting from firing of the cartridge propellant mix, which sealing is effective for a time delay period dependent upon the selected composition of the igniter plugs and the length thereof. This time delay is the total of the time period between ignition of the cartridge propellant mix 37, the subsequent ignition of the igniter plugs by the hot propellant gases and the ultimate burning through of the igniter plugs and ignition of the rocket propellant grain 61. Desirably, the rocket grain 61 is ignited after substantial forward travel of the projectile 41 and resultant reduction of gas pressure acting on the projectile 41, so as to minimize likelihood of improper rocket grain burning, and also to minimize the structural load bearing requirements on the projectile case 43** from internal gas pressures exerted thereon, it being noted that the internal pressures resulting from the rocket grain burning may be of the order of 2,000–7,000 psi, whereas the propellant gas burning pressures may peak as high as 50,000 psi or more and reduce thereafter as the projectile progresses down the barrel bore and ultimately exits therefrom.

This coaxial case/grain/penetrator structural arrangement provides a rocket assisted and enclosed rocket grain chamber projectile which does not require a high strength and consequent large volume and weight outer shell or casing, as such chamber and its bounding structure is not required in this arrangement to be subjected to the high pressure internal loads otherwise imposed by the gun propellant gases if such are permitted to immediately enter the rocket grain chamber.

This coaxial projectile construction thus enables employment of a thin-walled shell 43 encompassing a tubular end burning rocket grain 61 within an initially fully sealed chamber during initial propellant burning, while enabling maximizing of the rocket grain mass and/or penetrator mass.

The projectile ignition function begins within the barrel or the cartridge case, at which time the ignition delay plug igniters pressed within the nozzle block are ignited by the burning cartridge propellants. The ignition delay burns for a predetermined time as established by its composition and length until the projectile 41 is clear of the barrel 11 and has traveled to a predetermined point down range, at which time burn through and rocket grain ignition occurs either directly by the burning delay igniters 49, or indirectly thereto through intermediate ignition of a second fire igniter paper wafer 81. To this end, a second fire igniter or ignition wafer 81, in the form of a sheet of pyrotechnic fast burning heat generating igniter paper 81, may be provided, which when ignited by the burn through of the delay plug ignition will then flash and ignite the rocket grain across its full end surface. A suitable such intermediate pyrotechnic igniter paper may be formed of an asbestos fiber mat paper wafer impregnated with a mixture of barium chromate and zirconium. A suitable commercially available igniter paper is marketed under the name Catalyst Research Corporation Part Number 403644. The end burning of the rocket grain 61 provides sufficient thrust over a predetermined period of time to overcome part of the projectile drag and achieve a residual velocity substantially greater than than achieved with a conventional projectile. Because the paper wafer 81 is extremely sensitive to fire, it is readily ignited, when subjected to flame from the small diameter igniter column, and the paper impregnation mix slash burning produces sufficient heat to ignite the rocket grain across its full rear end in contact with the paper wafer 81, even if one plug igniter should burn through first. By using this easily flashed exothermic paper wafer second igniter it is not necessary to attempt to maintain an air gap between the relative small diameter delay plug itniters and the substantially larger surfaces rear end of rocket grain 61. The paper wafer second igniter 81 has been found to operate successfully and reliably under the extreme acceleration forces encountered in firing the projectile from its cartridge, whereas effecting full end surface ignition directly from the first fire delay plug igniters 49 has been extremely difficult to achieve through such measures as employing a small longitudinal air gap between the rear end of the rocket grain and the forward face of the delay plug igniters 49, which difficulty has been apparently caused at least in part by set-back displacement of the rocket grain against the plug igniters under the large acceleration forces during firing of the projectile from the cartridge.

During debulleting or exit of the projectile 41 from the cartridge case 33, the securing skirt **43*a* at the rear end of projectile 41 slides forwardly out of the case 33, and during this forward motion the skirt 43*a* is externally unsupported radially over its progressively increasing length portion extending between the rotating band 43*b* and the forward mouth end of cartridge case 33. As a result, the high pressures within the case 33 from burning of propellant mix 37 may cause sufficiently large hoop tension stresses in the case securing skirt 43*a*** to crack or otherwise fail the skirt, which cracking or failure may extend to the rocket grain containment portion of the case, with obvious deficiency in operation of the projectile.

As a solution to this problem, the securing skirt **43*a* and retaining sleeve 46 have at least one radial or otherwise transverse small vent hole 55 formed therein for gas passage between the interior and exterior of skirt 43*a*. Preferably, at least two equally annularly spaced small vent holes 55 are so formed to enable laterally even and quick pressure equalization. The longitudinal position of the vent holes 55 is preferably established relative to the spacing of the gun barrel rifling 15 forward of the chambered position of the rotating band 43*b*, such that the pressurized gas venting through vent holes 55 will not occur until the rotating band 43*b* has entered the rifling, as premature leakage of propellant gas past the rotating band 43*b*, such as may occur in the barrel zone rearward of the rifling, will be detrimental to projectile performance. To this end, the distance between vent holes 55 and the rear end of securing skirt 43*a* is greater than the distance between the rotating band 43*b* and the bore rifling 15** when the cartridge is fully chambered.

While the projectile construction finds its primary and preferred form as a rocket assisted projectile, as illustrated and described above, the unique projectile construction offers distinct advantages when employed without the rocket propellant grain therein, thus providing a coaxial projectile case/penetrator with dual internal axially spaced front and rear supports for the penetrator, and in such event the rear support block need not serve also as a nozzle block or plate as in the illustrated embodiment. Requirement for the vent holes in the securing skirt is dependent on the exposed length and strength of such skirt behind the rear support block and the propellant gas pressures to which the skirt is subjected in a given embodiment.

While the invention has been illustrated and described with respect to a single illustrative embodiment, it will be apparent that various modifications and improvements may be made without departing from the scope and spirit of the invention. Accordingly the invention is not to be limited by the illustrative embodiment, but only by the scope of the appended claims.

We claim:

1. A rocket assisted projectile comprising a thin-walled body shell, longitudinally spaced forward and rear penetrator supports within said shell and having aligned coaxial bores formed therein and extending therethrough, a central penetrator mass coaxially supported by and mutually rigidifying said thin-walled body shell by being longitudinally and laterally rigidly secured, both prior to and during projectile flight, in sealed relation within and extending through and axially beyond each of said support bores, said rear support forming a nozzle block having a plurality of discharge nozzles formed therein, said central penetrator mass, thin-walled shell and spaced supports forming a sealed chamber for containment of a rocket propellant therewithin, and end-burning rocket propellant grain disposed within said chamber and having its effective burning end facing said nozzle block, said nozzle block discharge nozzles being plugged in pressure-sealing relation with solid ignitable time delay plug igniters to thereby prevent initial entry of propellant gases at initial high propellant gas pressures into the rocket grain chamber, while enabling ultimate ignition of the rocket propellant by intermediate ignition of said solid ignitable time delay plugs from propellant gases external of the projectile and in contact with said time delay plug igniters, said central penetrator mass forming a multi-function element as a chamber-bounding element for the rocket propellant, a rigidifying element structurally cooperating with and enabling employment of a thin-walled body shell, and as a radial concentrator of mass for maximizing accuracy of flight and maximizing target penetration.

2. The rocket assisted projectile of claim 1, said rocket propellant grain being a ring grain having an inhibitor along its radially inner, outer and forward surfaces.

3. A cartridge comprising a casing having an ignitable propellant therein for propelling a rocket assisted projectile therefrom, and a rocket assisted projectile secured within said casing with its rear end adjacent said propellant and contactable by the burning propellant gases resulting from ignition of said propellant, said rocket assisted projectile comprising a thin-walled body shell, longitudinally spaced forward and rear penetrator supports within said shell and having aligned coaxial bores formed therein and extending therethrough, a central penetrator mass coaxially supported by and mutually rigidifying said thin-walled body shell by being longitudinally and laterally rigidly secured, both prior to and during projectile flight, in sealed relation within and extending through and axially beyond each of said support bores, said rear support forming a nozzle block having a plurality of discharge nozzles formed therein, said central penetrator mass, thin-walled shell and spaced supports forming a sealed chamber for containment of a rocket propellant therewithin, and end-burning rocket propellant grain disposed within said chamber and having its effective burning end facing said nozzle block, said nozzle block discharge nozzles being plugged in pressure-sealing relation with solid ignitable time delay plug igniters to thereby prevent initial entry of propellant gases at initial high propellant gas pressures into the rocket grain chamber, while enabling ultimate ignition of the rocket propellant by intermediate ignition of said solid ignitable time delay plugs from propellant gases external of the projectile and in contact with said time delay plug igniters, said central penetrator mass forming a multi-function element as a chamber-bounding element for the rocket propellant, a rigidifying element structurally cooperating with and enabling employment of a thin-walled body shell, and as a radial concentrator of mass of maximizing accuracy of flight and maximizing target penetration.

4. A cartridge comprising a casing having an ignitable propellant therein for propelling a rocket assisted projectile therefrom, and a rocket assisted projectile secured within said casing with its rear end adjacent said propellant and contactable by the burning propellant gases resulting from ignition of said propellant, said rocket assisted projectile comprising a thin-walled body shell, longitudinally spaced forward and rear penetrator supports within said shell and having aligned coaxial bores formed therein and extending therethrough, a central penetrator mass coaxially supported by and mutually rigidifying said thin-walled body shell by being longitudinally and laterally rigidly secured, both prior to and during projectile flight, in sealed relation within and extending through and axially beyond each of said support bores, said rear support forming a nozzle block having a plurality of discharge nozzle formed therein, said central penetrator mass, thin-walled shell and spaced supports forming a sealed chamber for containment of a rocket propellant therewithin, and end-burning rocket propellant grain disposed within said chamber and having its effective burning end facing said nozzle block, said nozzle block discharge nozzles being plugged in pressure-sealing relation with solid ignitable time delay plug igniters to thereby prevent initial entry of propellant gases at initial high propellant gas pressures into the rocket grain chamber, while enabling ultimate ignition of the rocket propellant by intermediate ignition of said solid ignitable time delay plugs from propellant gases enternal of the projectile and in contact with said time delay plug igniters, said central penetrator mass forming a multi-function element as a chamber-bounding element for the rocket propellant, a rigidifying element structurally cooperating with an enabling employment of a thin-walled body shell, and as a radial concentrator of mass for maximizing accuracy of flight and maximizing target penetration said rocket propellant grain being a ring grain having an inhibitor along its radially inner, outer and forward surfaces.

* * * * *